US011227572B2

(12) United States Patent
Yoshino

(10) Patent No.: US 11,227,572 B2
(45) Date of Patent: Jan. 18, 2022

(54) ACCOMPANIMENT CONTROL DEVICE, ELECTRONIC MUSICAL INSTRUMENT, CONTROL METHOD AND STORAGE MEDIUM

(71) Applicant: CASIO COMPUTER CO., LTD., Tokyo (JP)

(72) Inventor: Jun Yoshino, Musashimurayama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/810,728

(22) Filed: Mar. 5, 2020

(65) Prior Publication Data

US 2020/0312289 A1 Oct. 1, 2020

(30) Foreign Application Priority Data

Mar. 25, 2019 (JP) ..... JP2019-055952
Jan. 23, 2020 (JP) ..... JP2020-009156

(51) Int. Cl.
*G10H 1/36* (2006.01)
*G10H 1/46* (2006.01)
*G10H 1/00* (2006.01)

(52) U.S. Cl.
CPC ..... *G10H 1/361* (2013.01); *G10H 1/0008* (2013.01); *G10H 1/46* (2013.01); *G10H 2210/005* (2013.01)

(58) Field of Classification Search
CPC ..... G10H 1/361; G10H 1/0008; G10H 1/46; G10H 2210/005
USPC ..... 84/634
See application file for complete search history.

(56) References Cited

U.S. PATENT DOCUMENTS 3,619,469 A * 11/1971 Adachi ..... G10H 1/0555 84/688
4,300,433 A * 11/1981 Schreier ..... G10H 1/38 84/712
4,361,067 A * 11/1982 Ishii ..... G10H 1/38 84/633
4,539,882 A * 9/1985 Yuzawa ..... G10H 1/36 84/610
5,179,240 A * 1/1993 Mizuno ..... G10H 1/186 84/613
5,296,643 A * 3/1994 Kuo ..... H04H 60/13 434/307 A
5,811,707 A * 9/1998 Kakehashi ..... H04H 60/04 84/610
5,998,725 A * 12/1999 Ohta ..... 84/609
8,084,680 B2 12/2011 Kato et al.
10,304,430 B2 5/2019 Nakamura
10,529,312 B1 * 1/2020 Adams ..... G10H 1/366
(Continued)

FOREIGN PATENT DOCUMENTS

JP H04243295 A 8/1992
JP H10214088 A 8/1998
(Continued)

*Primary Examiner* — Christina M Schreiber
(74) *Attorney, Agent, or Firm* — Holtz, Holtz & Volek PC

(57) ABSTRACT

An electronic musical instrument having an accompaniment function which detects the sound volume of inputted melody sounds for each sound range, and controls the sound volume of accompaniment sounds for each sound range in accordance with the detected sound volume of the melody sounds for each sound range.

18 Claims, 9 Drawing Sheets

(56) References Cited

U.S. PATENT DOCUMENTS

| | | | | |
|---|---|---|---|---|
| 2003/0160702 | A1* | 8/2003 | Tanaka | G10H 1/00 340/693.3 |
| 2006/0075882 | A1* | 4/2006 | Ikeya | G10H 1/0016 84/609 |
| 2010/0269672 | A1* | 10/2010 | Kato | G10H 1/32 84/743 |
| 2013/0298750 | A1* | 11/2013 | Kira | G10H 1/386 84/613 |
| 2018/0219521 | A1* | 8/2018 | Arimoto | H03G 3/32 |
| 2018/0277075 | A1* | 9/2018 | Nakamura | G10H 1/46 |
| 2018/0357920 | A1* | 12/2018 | Terashima | G09B 15/00 |
| 2019/0051275 | A1* | 2/2019 | Ka | G06F 16/634 |
| 2020/0312289 | A1* | 10/2020 | Yoshino | G10H 1/46 |
| 2021/0241738 | A1* | 8/2021 | Chen | G10H 1/0008 |

FOREIGN PATENT DOCUMENTS

| | | | |
|---|---|---|---|
| JP | 2010152233 | A | 7/2010 |
| JP | 2018159831 | A | 10/2018 |

* cited by examiner

<BASS PART>

| TIMING | PITCH | VELOCITY | SOUND LENGTH |
|---|---|---|---|
| 1:1:0 | C3 | 110 | 70 |
| 1:2:0 | C3 | 100 | 70 |
| 1:3:0 | C3 | 100 | 70 |
| 1:4:0 | C3 | 100 | 70 |

<CHORD PART>

| TIMING | PITCH | VELOCITY | SOUND LENGTH |
|---|---|---|---|
| 1:1:0 | C4 | 100 | 160 |
| 1:1:0 | E4 | 100 | 160 |
| 1:1:0 | G4 | 100 | 160 |
| 1:3:0 | C4 | 100 | 160 |
| 1:3:0 | E4 | 100 | 160 |
| 1:3:0 | G4 | 100 | 160 |

<OBBLIGATO PART>

| TIMING | PITCH | VELOCITY | SOUND LENGTH |
|---|---|---|---|
| 1:1:0 | C5 | 90 | 40 |
| 1:1:48 | E5 | 80 | 40 |
| 1:2:0 | G5 | 80 | 40 |
| 1:2:48 | E5 | 80 | 40 |
| 1:3:0 | C5 | 90 | 40 |
| 1:3:48 | E5 | 80 | 40 |
| 1:4:0 | G5 | 80 | 40 |
| 1:4:48 | E5 | 80 | 40 |

<PITCH CONVERSION EXAMPLE>

(ACCOMPANIMENT DATA)

(CASE OF F CHORD)

ACCOMPANIMENT CONTROL DEVICE, ELECTRONIC MUSICAL INSTRUMENT, CONTROL METHOD AND STORAGE MEDIUM

CROSS-REFERENCE TO RELATED APPLICATIONS

This application is based upon and claims the benefit of priority from the prior Japanese Patent Applications No. 2019-055952 filed Mar. 25, 2019, and No. 2020-009156, filed Jan. 23, 2020, the entire contents of which are incorporated herein by reference.

BACKGROUND OF THE INVENTION

1. Field of the Invention

The present invention relates to an accompaniment control device that is applicable to electronic musical instruments.

2. Description of the Related Art

Conventionally, electronic keyboard musical instruments such as electronic keyboards and electronic pianos are known which have an accompaniment function for outputting accompaniment sounds in accordance with a user's musical performance. As such an accompaniment function, various techniques have been developed. For example, Japanese Patent Application Laid-Open (Kokai) Publication No. 04-243295 discloses a technique in which the sound volume of accompaniment sounds to be outputted are controlled in accordance with the presence and intensity of melody sounds that are inputted from a keyboard section, and whereby the melody sounds are highlighted.

SUMMARY OF THE INVENTION

In accordance with one aspect of the present invention, there is provided an accompaniment control device comprising: a control circuit which detects an input state of inputted melody sounds for each sound range, and controls a sound emission state of accompaniment sounds for each sound range in accordance with the detected input state of the melody sounds for each sound range.

In accordance with one aspect of the present invention, there is provided an electronic musical instrument comprising: a musical performance operation section; a control circuit; and a sound emission section, wherein the control circuit (i) generates melody sounds in accordance with a musical performance operation performed by a user using the musical performance operation section, (ii) generates accompaniment sounds corresponding to the generated melody sounds, (iii) detects an input state of the generated melody sounds for each sound range, and (iv) controls a sound emission state of the generated accompaniment sounds for each sound range in accordance with the detected input state of the melody sounds for each sound range, and wherein the sound emission section synchronizes the melody sounds with the accompaniment sounds whose sound emission state has been controlled for each sound range by the control circuit, and emits the melody sounds and the accompaniment sounds.

In accordance with one aspect of the present invention, there is provided a control method for controlling accompaniment sounds, wherein a device detects an input state of inputted melody sounds for each sound range, and controls a sound emission state of the accompaniment sounds for each sound range in accordance with the detected input state of the melody sounds for each sound range.

In accordance with one aspect of the present invention, there is provided a non-transitory computer-readable storage medium having stored thereon a program that is executable by a computer to actualize functions comprising: detecting an input state of inputted melody sounds for each sound range; and controlling a sound emission state of accompaniment sounds for each sound range in accordance with the detected input state of the melody sounds for each sound range.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Embodiments of an accompaniment control device, an accompaniment control method, a storage medium, and an electronic musical instrument equipped with the accompaniment control device will hereinafter be described with reference to the drawings.

<Electronic Musical Instrument>

Figure 1:
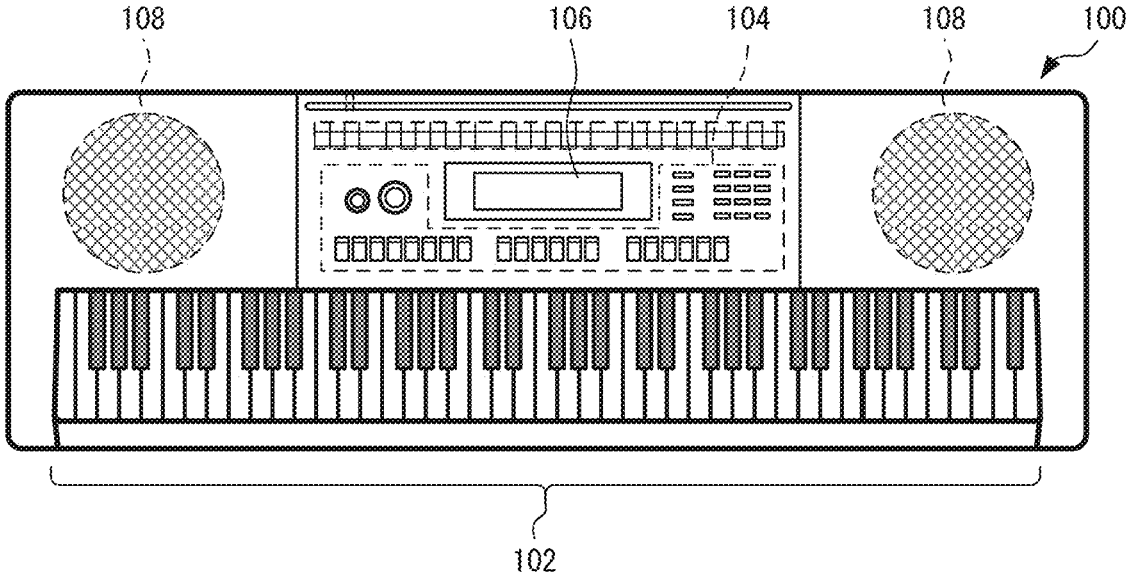
FIG. 1 is an external view of one embodiment of an electronic musical instrument equipped with an accompaniment control device according to the present invention.

FIG. 1 is an external view showing an embodiment of an electronic musical instrument equipped with an accompaniment device according to the present invention. Here, a case is described in which the present invention has been applied in an electronic keyboard instrument (an electronic keyboard or an electronic piano) serving as an example of the electronic musical instrument.

The electronic musical instrument 100 includes a keyboard 102 which has a plurality of keys provided on one side of the musical instrument main body as musical performance operators and is used to specify pitch, an operation panel 104 where switches have been arranged which are used to perform operations such as sound volume adjustment, tone selection, and other function selection, a display panel 106 for displaying various types of information such as information regarding sound volume and tones and setting information, and speakers 108 for emitting musical sounds generated by an instrument player operating the keyboard 102 and the operation panel 104, as shown in FIG. 1.

<Internal Functions and Control Operations>

Figure 2:
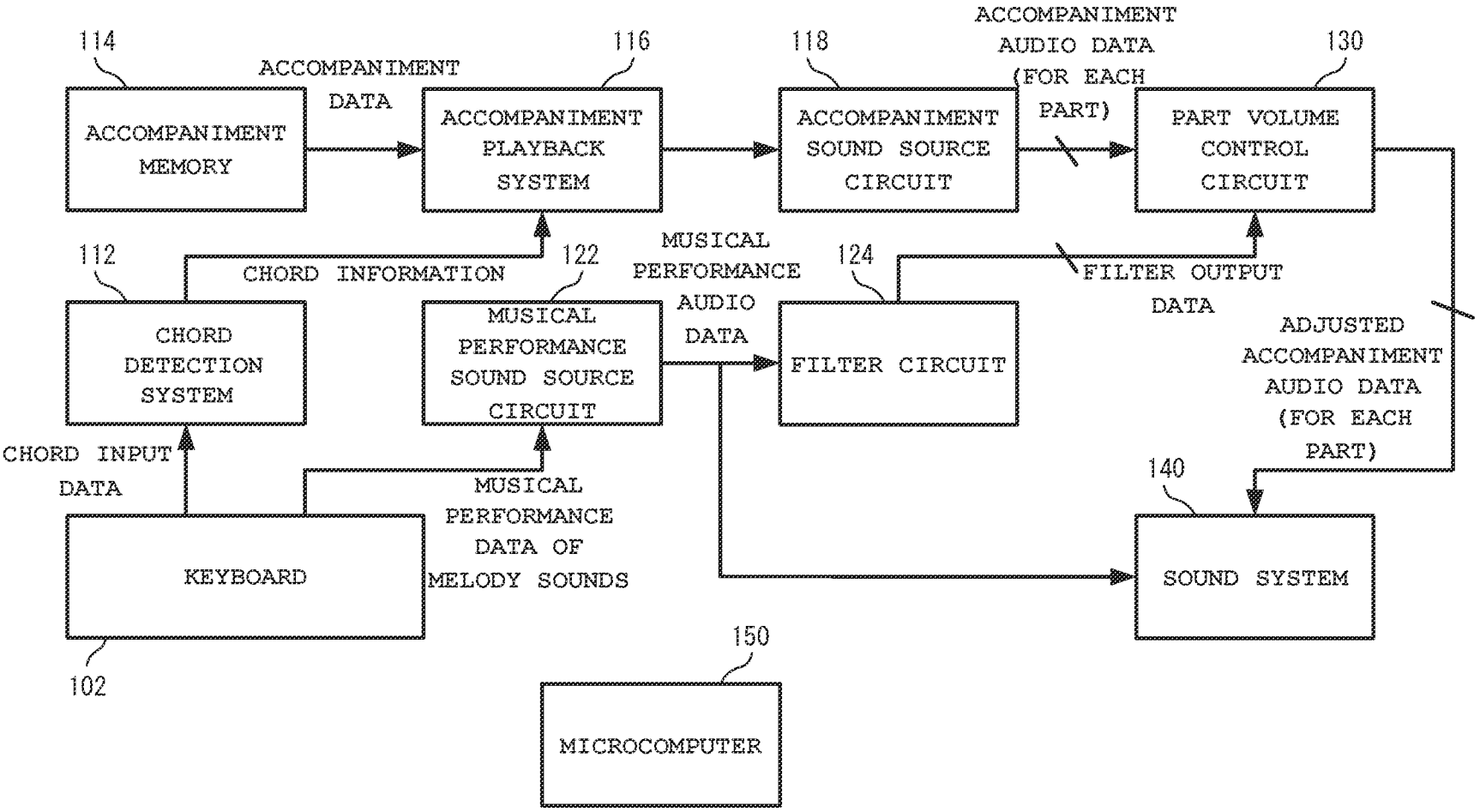
FIG. 2 is a block diagram showing an example of the hardware structure and control operations of the electronic musical instrument according to the embodiment.

Next, internal functions and control operations of the electronic musical instrument equipped with the accompaniment control device according to the present embodiment are described. FIG. 2 is a block diagram showing an example of the hardware structure and control operations of the electronic musical instrument according to the present embodiment.

The internal functions of the electronic musical instrument 100 according to the present embodiment are actualized by, for example, function sections including the keyboard 102 (musical performance operation section), a chord detection system 112 (chord detection circuit), an accompaniment memory 114, an accompaniment playback system 116 (accompaniment playback circuit), an accompaniment sound source circuit 118, a musical performance sound source circuit 122, a filter circuit 124 (sound range division section), a part volume control circuit 130, a sound system 140 (sound emission section), and a microcomputer 150 (processor), as shown in FIG. 2.

Here, each section may be actualized by a dedicated electronic circuit, or may be actualized by a general-purpose processor such as a DSP (Digital Signal Processor) or a CPU (Central Processing Unit) and a control program for causing this general-purpose processor to actualize various types of functions. Also, each of the electronic circuits, a group of some of the electronic circuits, and the processor operated by the control program may be referred to as a control circuit.

Each function section has at least a function for performing the later-described control operation. Note that this control operation is to adjust the sound volume of accompaniment sounds and is continually actualized by each function section being controlled by the execution of a predetermined program in the microcomputer 150 during a musical performance by the instrument player.

Among a plurality of keys on the keyboard 102, a portion (such as keys corresponding to two octaves) of a low key area on the left hand side of the instrument player is used as a key area for inputting chords, and a key area other than this key area for chord input on the keyboard 102 (that is, a key area including a high key area on the right hand side of the instrument player) is used as a key area for playing the melody line of a musical piece. Chord input data inputted by the instrument player pressing keys in the chord input key area on the keyboard 102 is outputted to the chord detection system 112, and melody performance data inputted by the instrument player pressing keys in the melody input key area on the keyboard 102 is outputted to the musical performance sound source circuit 122. Here, the key areas for chord input and melody input on the keyboard 102 may be key areas set in advance by hardware, or may be key areas set by software control in accordance with chords.

The chord detection system 112 detects chord information from chord input data inputted through the chord input key area of the keyboard 102, and outputs the chord information to the accompaniment playback system 116. More specifically, The chord detection system 112 extracts a route value and a chord type value defining a chord on the basis of a pattern of key depression by the instrument player, and outputs chord information including these values to the accompaniment playback system 116. For example, when the instrument player presses keys in the chord input key area in the order of "DO", "MI" and "SO", the root value is C and the chord type is M (major). Also, when the instrument player presses keys in the order of "DO", "MI b (flat)" and "SO", the root value is C and the chord type is m (minor). Moreover, when the instrument player presses keys in the order of "DO", "FA" and "LA", the root value is F and the chord type is M (major).

Figure 3A:
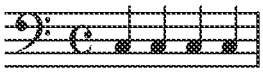
FIG. 3A and FIG. 3B are first diagrams showing examples of accompaniment data that are stored in an accompaniment memory applied in the electronic musical instrument according to the embodiment.
Figure 3B:
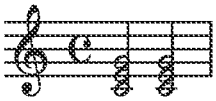
Figure 4:
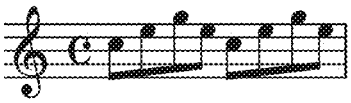
FIG. 4 is a second diagram showing an example of accompaniment data that is stored in the accompaniment memory applied in the electronic musical instrument according to the embodiment.

FIG. 3 and FIG. 4 are diagrams showing examples of accompaniment data that are stored in the accompaniment memory applied in the electronic musical instrument according to the present embodiment. Here, FIG. 3A is a diagram showing an example of accompaniment data corresponding to a bass part, FIG. 3B is a diagram showing an example of accompaniment data corresponding to a chord part, and FIG. 4 is a diagram showing an example of accompaniment data corresponding to an obbligato part.

The accompaniment memory 114 stores the accompaniment data of various musical instruments and parts for accompaniment. The accompaniment data herein is constituted by, for example, data corresponding to one bar, and read out from the accompaniment memory 114 by the later-described accompaniment playback system 116 so as to be subjected to loop playback. For example, FIG. 3A shows a bass part which is accompaniment data corresponding to a low-pitched sound range. The upper part of the drawing is a table indicating the timing (the number of bars, beats, and ticks), pitch, velocity (128 levels from 0 to 127), and sound length (in units of ticks) of the bass part. The lower part of the drawing shows the bass part in the form of a musical score. That is, the accompaniment data of this bass part has been set to have a short sound length of 70 ticks per beat with respect to 96 ticks, a low pitch of C3 from the first beat to the fourth beat, and a velocity of 100 to 110. Also, FIG. 3B is a table and a musical score indicating a chord part which is accompaniment data corresponding to a middle-pitched sound range. The accompaniment data of this chord part has been set to have a long sound length of 160 ticks, pitches of C4, E4 and G4 (chord sounds) in both the first and second beats, and a velocity of 100. Moreover, FIG. 4 is a table and a musical score indicating an obbligato part which is accompaniment data corresponding to a high-pitched sound range. The accompaniment data of this obbligato part has been set to have a short sound length of 40 ticks, high pitches of C5, E5, G5 and E5 from the first beat to the eighth beat, and a velocity of 80 to 90. Here, the accompaniment data shown in FIG. 3 and FIG. 4 correspond to the respective sound ranges (low-pitched sound range, middle-pitched sound range, and high-pitched sound range) of musical performance data that are divided for each band by the filter circuit 124 described later.

Figure 5:
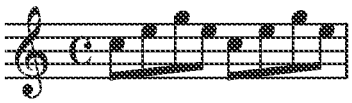
FIG. 5 is a diagram showing an example of musical pitch conversion in an accompaniment playback system applied in the electronic musical instrument according to the embodiment.
Figure 5:
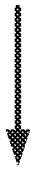
Figure 5:
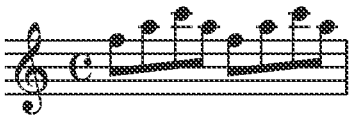

FIG. 5 is a diagram showing an example of musical pitch conversion in the accompaniment playback system applied in the electronic musical instrument according to the present embodiment.

The accompaniment playback system 116 reads out a part corresponding to a predetermined sound range from accompaniment data stored in the accompaniment memory 114, generates accompaniment data (generated data) based on chord information inputted from the chord detection system 112, and outputs the generated data to the accompaniment sound source circuit 118. For example, as shown in FIG. 5, the accompaniment playback system 116 reads out obbligato part data (a musical score in the upper part of the drawing) that is accompaniment data corresponding to a high-pitched sound range and stored in the accompaniment memory 114. Then, in a case where a root value included in inputted chord information is F, the accompaniment playback system 116 converts the pitch of the accompaniment data in accordance with this value, and thereby generates accompaniment data (generated data) corresponding to an F chord (which is shown in a musical score in the lower part of the drawing).

The accompaniment sound source circuit 118 converts accompaniment data (generated data) generated by the accompaniment playback system 116 into audio data (accompaniment audio data) for each part, and outputs the audio data to the part volume control circuit 130.

On the other hand, the musical performance sound source circuit 122 converts musical performance data inputted through the melody input key area of the keyboard 102 into audio data (musical performance audio data), and outputs the audio data to the filter circuit 124 and the sound system 140.

Figure 6:
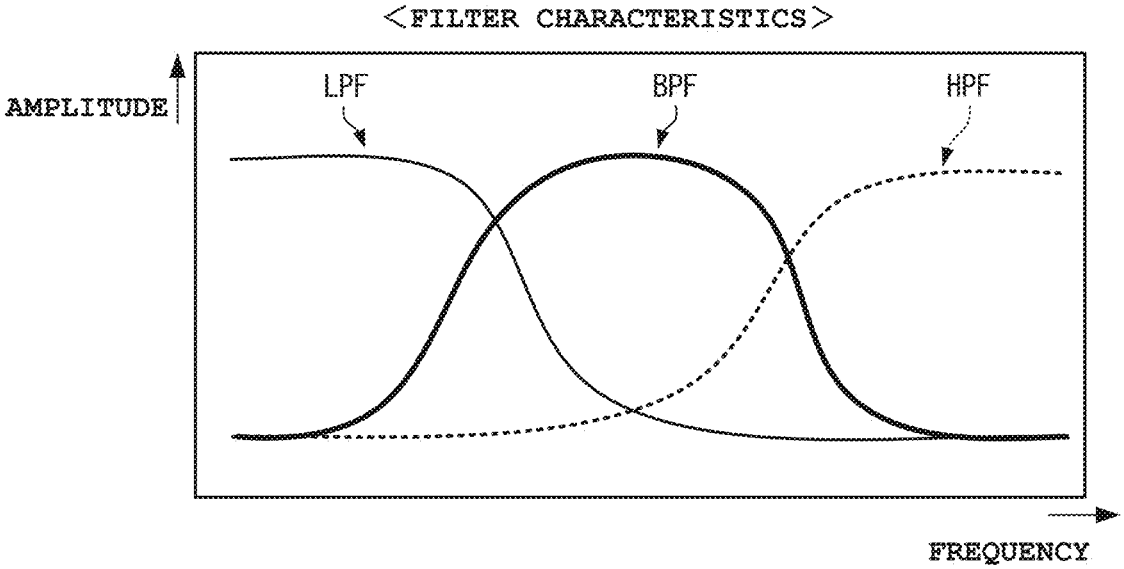
FIG. 6 is a diagram showing an example of the filter characteristics of a filter circuit applied in the electronic musical instrument according to the embodiment.

FIG. 6 is a diagram showing an example of the filter characteristics of the filter circuit applied in the electronic musical instrument according to the present embodiment. The filter circuit 124 divides musical performance audio data inputted from the musical performance sound source circuit 122 into the data of bands through a plurality of filters having different filter characteristics (band pass characteristics), and outputs them to the part volume control circuit 130 as filter output data. Here, the filter circuit 124 includes, for example, a low-pass filter LPF, a band-pass filter BPF, and a high-pass filter HPF as shown in FIG. 6. This filter circuit 124 performs band division on the musical performance audio data by use of the respective filter characteristics, and outputs the result (low-pass filter output data, band-pass filter output data, and high-pass filter output data) to the part volume control circuit 130 for each sound range.

Figure 7:
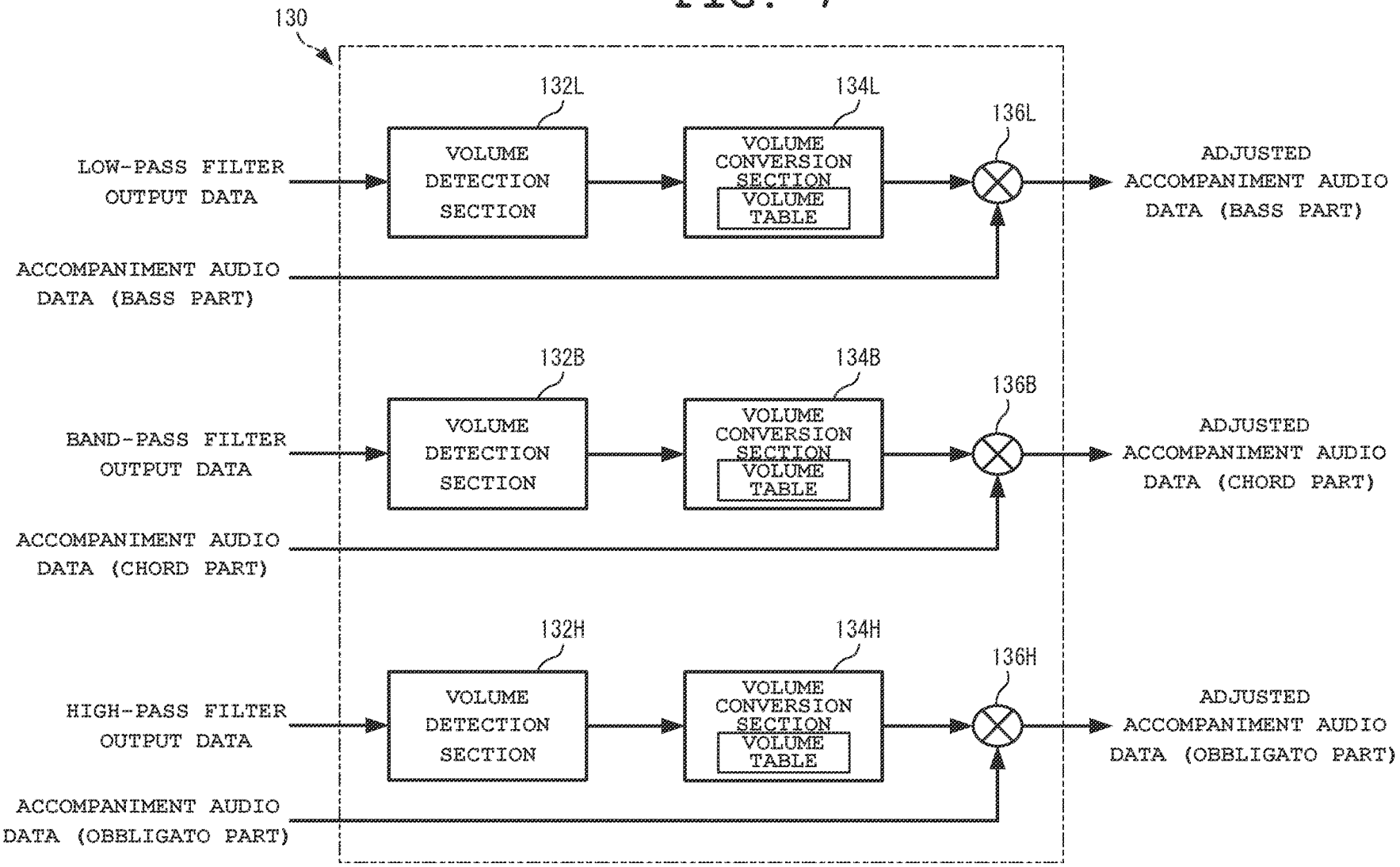
FIG. 7 is a block diagram showing an example of apart volume control circuit applied in the electronic musical instrument according to the embodiment.

FIG. 7 is a block diagram showing an example of the part volume control circuit applied in the electronic musical instrument according to the present embodiment. Also, FIG. 8 is a diagram showing an example of a volume table that is used in the part volume control circuit applied in the electronic musical instrument according to the present embodiment.

The part volume control circuit 130 adjusts the sound volume of the accompaniment audio data of each part inputted from the accompaniment sound source circuit 118 as needed, on the basis of the filter output data of each sound range inputted from the filter circuit 124, and outputs them to the sound system 140. Here, the part volume control circuit 130 includes, for example, volume detection sections 132L, 132B, and 132H that detect sound volume absolute values (volume values) for each filter output data acquired by band division by the filter circuit 124, and volume conversion sections 134L, 134B, and 134H that convert the detected volume values by using predetermined volume tables, as shown in FIG. 7.

The part volume control circuit 130 repeatedly executes, by the volume detection section 132L, an operation of performing waveform peak detection for musical performance audio data (low-pass filter output data) acquired by band division by the low-pass filter LPF of the filter circuit 124 shown in FIG. 6, by extracting data at certain intervals (such as several hundred milliseconds) by using window functions or the like, and of extracting the average value or maximum value of detected peak values as a volume detection value. In addition, for musical performance audio data (band-pass filter output data and high-pass filter output data) acquired by band division by the band-pass filter BPF and high-pass filter HPF of the filter circuit 124 as well, the part volume control circuit 130 repeatedly executes an operation of acquiring volume detection values by the volume detection unit 132B and the volume detection unit 132H by using a method similar to that described above.

Figure 8:
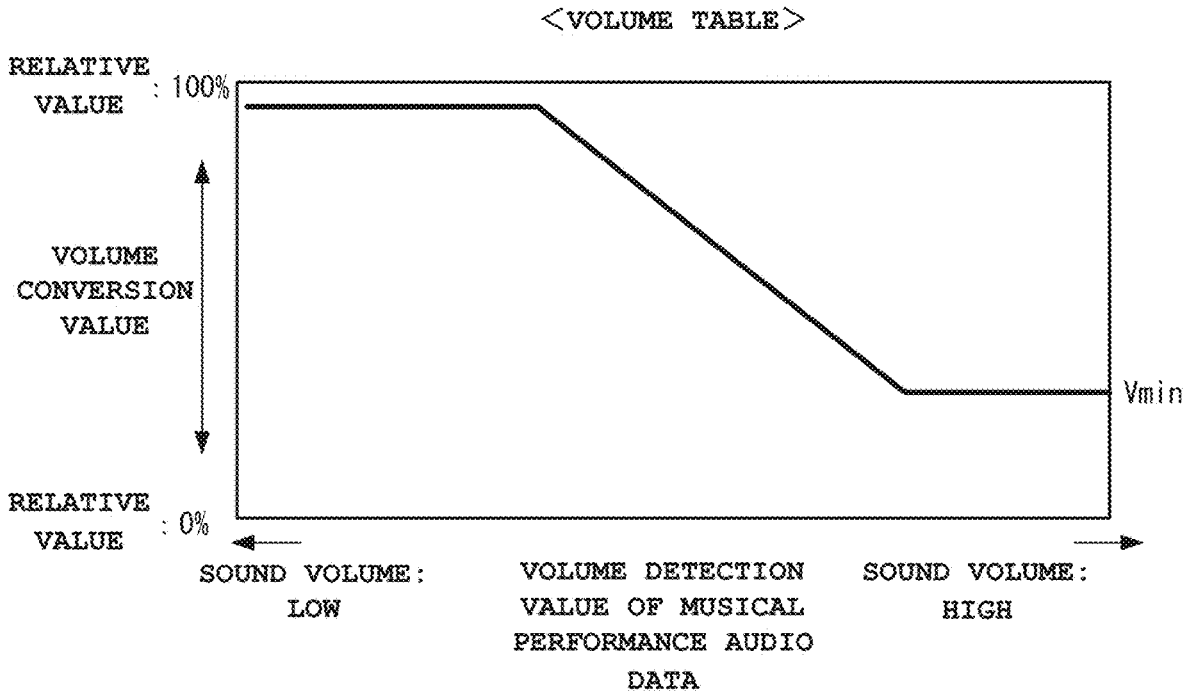
FIG. 8 is a diagram showing an example of a volume table that is used in the part volume control circuit applied in the electronic musical instrument according to the embodiment.

Next, for each volume detection value detected by the volume detection sections 132L, 132B, and 132H for each musical performance audio data acquired by band division, the part volume control circuit 130 repeatedly executes volume conversion processing using a volume table such as that shown in FIG. 8 by the volume conversion sections 134L, 134B, and 134H.

The volume table shown in FIG. 8 has a conversion characteristic in which, when a volume value (volume detection value) on the input side which has been detected from musical performance audio data is on the horizontal axis and a conversion value (volume conversion value) on the output side is on the vertical axis, the volume conversion value becomes smaller as the volume detection value becomes larger. More specifically, the volume table has a conversion characteristic set therein in which, in a range where a volume detection value detected by the above-described volume detection section 132L, 132B, or 132H is small, the relative value is set to 100% with respect to a preset accompaniment sound volume, and becomes smaller as the volume detection value becomes larger. Moreover, in this conversion characteristic, in a range where the volume detection value is larger than a predetermined value, the relative value converges to a preset lower limit value. Here, the conversion characteristic of this volume table may be set such that, in a range where the volume detection value is sufficiently large, the relative value converges to a predetermined lower limit value Vmin where it does not become 0% (such as a relative value of 20%) as shown in FIG. 8, or may be set such that the relative value converges to 0%.

Plural types of volume tables such as that described above are prepared for the respective parts of accompaniment data stored in the accompaniment memory 114 and, in each volume conversion section 134L, 134B, or 134H, a volume table having a unique transfer characteristic is set. As a result, the sound volume of the melody sounds of each sound range based on musical performance audio data and the sound volume of the accompaniment sounds of each sound range adjusted by the part volume control circuit 130 are controlled in advance to be states different from each other as described later. More specifically, the sound volume of accompaniment sounds is controlled to be different for each sound range in accordance with the sound volume differences of melody sounds among the sound ranges. Also, control is performed such that the sound volume of accompaniment sounds is low in a sound range where the sound volume of melody sounds is high, and the sound volume of accompaniment sounds is decreased as the sound volume of melody sounds is increased in each sound range.

Note that, for example, the conversion characteristic of each volume table may be arbitrarily selected or adjusted by the instrument player performing a switch operation or the like, or may be automatically selected by the microcomputer 150 in accordance with the genre, tone, and the like of a musical piece to be played. Also, in FIG. 8, the example has been shown in which, as the conversion characteristic of a volume table, a volume conversion value is varied linearly. However, a conversion characteristic where a volume conversion value is varied in a curve may be adopted as long as it has an equivalent change tendency. Moreover, although the example has been shown in which a volume conversion value to be set by a volume table is set with a relative value in accordance with a volume detection value, a configuration may be adopted in which a volume conversion value is set with an absolute value (at 128 levels from 0 to 127, for example).

Next, the part volume control circuit 130 multiplies the accompaniment audio data of each part inputted from the accompaniment sound source circuit 118 by a volume conversion value set using a volume table, and thereby adjusts the sound volume of the accompaniment sounds. For example, by a multiplier 136L, the accompaniment audio data of a low-pitched sound range inputted from the accompaniment sound source circuit 118 is multiplied by a volume conversion value set on the basis of low-pass filter output data inputted from the filter circuit 124 as shown in FIG. 7, so that the sound volume of the bass part is adjusted. This accompaniment audio data whose sound volume has been adjusted is outputted to the sound system 140. Also, by a multiplier 136B, the accompaniment audio data of a middle-pitched sound range, that is, the accompaniment audio data of the chord part is multiplied by a volume conversion value set on the basis of band-pass filter output data inputted from the filter circuit 124. Moreover, by a multiplier 136H, the accompaniment audio data of a high-pitched sound range, that is, the accompaniment audio data of the obbligato part is multiplied by a volume conversion value set on the basis of high-pass filter output data. These accompaniment sound volume adjustments of the respective parts are performed simultaneously and parallelly.

The sound system 140 performs an operation of executing analog processing such as signal amplification on musical performance audio data inputted from the musical performance sound source circuit 122 and accompaniment audio data whose sound volume has been adjusted and which has been inputted from the part volume control circuit 130, synchronizing the melody sounds and the accompaniment sounds, and outputting them from the speakers 108 or the like as musical sounds with accompaniment.

As described above, in the present embodiment, during a musical performance by the instrument player, control is continually performed in which musical performance data inputted via the keyboard 102 is subjected to band division by the filter circuit 124, the sound volumes (volume values) of different sound ranges are detected by the volume detection units 132L, 132B, and 132H of the part volume control circuit 130, and the accompaniment sound volume of each part corresponding to each sound range is controlled in accordance with the sound volumes detected by the volume conversion sections 134L, 134B, and 134H. That is, for each sound range, the sound volume of melody sounds and the sound volume of accompaniment sounds are controlled to be in predetermined different states. For example, when the sound volume of the low-pitched sound range of musical performance data is high, the sound volume of the bass part (low-pitched range) of accompaniment data is decreased. When the sound volume of the high-pitched sound range of the musical performance data is high, the sound volume of the obbligato part (high-pitched range) of the accompaniment data is decreased. That is, in each sound range, the sound volume of accompaniment sounds is decreased as the sound volume of melody sounds is increased. As a result of this configuration, in a sound range where the sound volume of melody sounds is high, the sound volume of accompaniment sounds is adjusted to be low. Also, the sound volume of accompaniment sounds is adjusted to be different for each sound range in accordance with the sound volume differences of melody sounds among the sound ranges.

As a result, in the present embodiment, a phenomenon is resolved in which melody sounds become hard to hear or musical sounds being played give a sense of incongruity or unnaturalness due to the melody sounds and accompaniment sounds having the same or a similar sound pitch, sound volume, and sound range. Accordingly, it is possible to replay natural accompaniment sounds while highlighting melody sounds played by the instrument player irrespective of the performance status of the electronic musical instrument.

Figure 9:
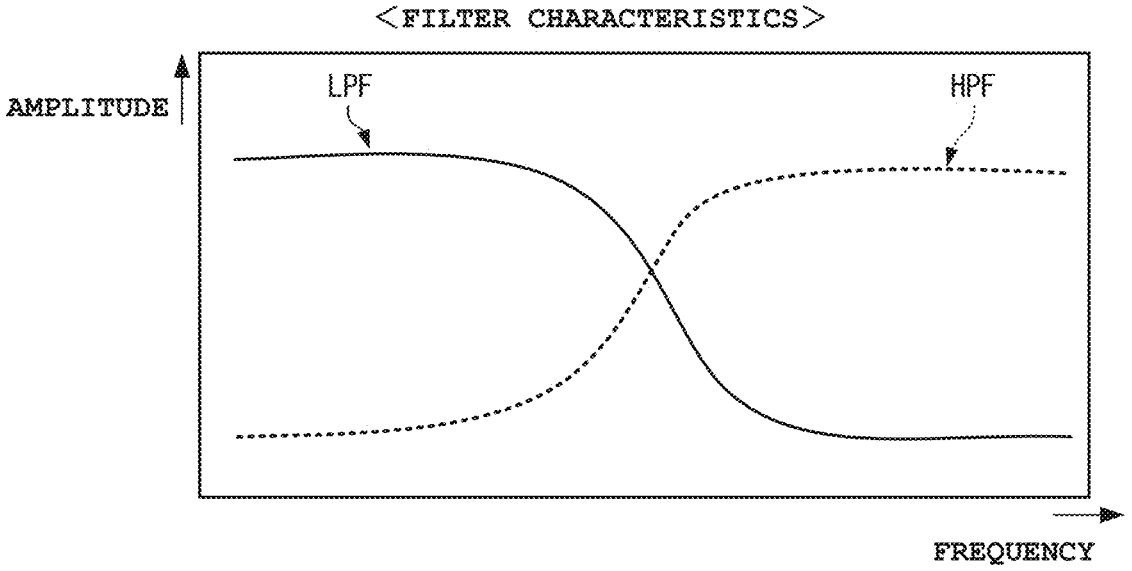
FIG. 9 is a characteristic diagram showing another example of the filter circuit applied in the electronic musical instrument according to the embodiment.

In the above-described embodiment, musical performance audio data is subjected to band division by using the three types of filters, that is, the low-pass filter LPF, the band-pass filter BPF, and the high-pass filter HPF as the filter circuit, and the respective sound ranges are associated with the respective parts of accompaniment data. However, the present invention is not limited thereto, and a configuration may be adopted in which the number of data to be acquired by band division by the filter circuit 124 is set to 2, 4 or more. For example, a configuration may be adopted in which the filter circuit 124 includes the low-pass filter LPF and the high-pass filter HPF, and associates results acquired by band division by the respective filter characteristics with a bass part (low-pitched sound range) and a chord part (middle and high-pitched sound range), as shown in FIG. 9. Here, FIG. 9 is a characteristic diagram showing another example of the filter circuit applied in the electronic musical instrument according to the present embodiment.

Also, although musical performance audio data is subjected to band division using the filter circuit in the above-described embodiment, the present invention is not limited thereto. For example, a configuration may be adopted in which musical performance audio data is subjected to band division by an algorithm adopting FFT (Fast Fourier Transform) processing.

Moreover, in the above-described embodiment, audio data (musical performance audio data) inputted via the keyboard is converted, and subjected to band division by using the filter circuit. Then, the sound volume of accompaniment audio data is controlled for each part having a different sound range. However, the present invention is not limited thereto, and a configuration may be adopted in which the sound volume of accompaniment data is controlled simply for each sound range group irrespective of parts. In that case, for example, a configuration may be adopted in which any number of adjacent sound pitches (or only one sound pitch) are set as one group, musical performance audio data (sound pitch information) is directly inputted into the part volume control circuit 130 for each sound range group without the filter circuit 124 shown in FIG. 2, the volume value of each sound range group is detected, and the sound volume of accompaniment audio data is controlled for each sound range group.

Modification Example 1

In the above-described embodiment, in a case where the instrument player performs a musical performance such that an audience mainly hears melody sounds, the sound volume of accompaniment sounds is decreased in a sound range where the sound volume of melody sounds is high, whereby the phenomenon is prevented in which melody sounds become hard to hear due to accompaniment sounds in the same sound range as that of the melody sounds. However, the above-described embodiment may be modified to achieve other purposes. For example, in a case where a phenomenon is desired to be prevented in which accompaniment sounds in the same sound range as that of melody sounds become hard to hear due to the melody sounds or a case where the sound range of melody sounds is desired to be highlighted together with accompaniment sounds, a modification may be made by which the sound volume of accompaniment sounds is set to be increased in a sound range where the sound volume of melody sounds is high. In that case, it is only required that the volume table shown in FIG. 8 be set such that a volume conversion value is increased as a volume detection value of musical performance audio data is increased. The curve of this transfer characteristic may be arbitrarily set as with the above-described embodiment.

Modification Example 2

In the above-described embodiment, the sound volume of accompaniment sounds in each sound range is controlled in accordance with the sound volume of melody sounds in each sound range, whereby a relation between the sound volume of melody sounds in each sound range and the sound volume of accompaniment sounds in each sound range enters an intended state. However, the above-described embodiment may be modified such that a sound effect (such as a reverberation effect) for accompaniment sounds in each sound range is controlled in accordance with the sound volume of melody sounds in each sound range. In this case, the part volume control circuit 130 shown in FIG. 2 and FIG. 7 is replaced with an audio control circuit that controls a sound effect for each part. More specifically, the multiplier 136L, the multiplier 136B, and the multiplier 136H shown in FIG. 7 are replaced with sound effect appliers. These sound effect appliers apply a sound effect such as a reverberation effect to the respective accompaniment audio data of a low-pitched sound range, a middle-pitched sound range, and a high-pitched sound range inputted from the accompaniment sound source circuit 118, and then output them to the sound system 140. Then, the levels of the sound effects applied by the sound effect applier are changed on the basis of volume conversion values set by the volume conversion sections 134L, 134B, and 134H. As a method for changing the levels of the sound effects on the basis of some designated values, a well-known method can be used.

Modification Example 3

In the above-described embodiment, the sound emission state (sound volume or sound effect) of accompaniment sounds in each sound range is controlled in accordance with the sound volume of melody sounds in each sound range. However, the present invention is not limited thereto, and a configuration may be adopted in which the sound emission state of accompaniment sounds in each sound range is controlled in accordance with not the state of the sound volume of melody sounds in each sound range but the input state (presence of input or frequency/density of inputs) of melody sounds in each sound range excluding the state of the sound volume thereof.

In this case, the number of times of sound (musical sound) inputs by a musical performance is counted for each sound range and each unit time, and the number of times of inputs for each unit time serves as a volume detection value. Alternatively, input pulses corresponding to each sound inputted by a musical performance are inputted into a filter having a predetermined time constant for each sound range, and an output of this filter serves as a volume detection value.

Also, although the embodiment has been described under the assumption that the present invention is applied in an electronic musical instrument having a so-called automatic musical performance function or semiautomatic musical performance function, the present invention is not limited thereto, and is favorably applicable to a case where an instrument player manually plays an accompaniment by the keyboard 102. Also, the above-described melody sounds to be inputted may be melody sounds other than those to be inputted by an instrument player in real time, such as melody sounds recorded in a past musical performance or melody sounds extracted from musical piece data.

Moreover, in the above-described embodiment, the present invention has been applied in an electronic keyboard musical instrument serving as an example of an electronic musical instrument. However, the present invention is not limited thereto and is applicable to, for example, other electronic musical instruments having the form of a wind instrument or a stringed instrument as long as they are electronic musical instruments having an accompaniment function.

While the present invention has been described with reference to the preferred embodiments, it is intended that the invention be not limited by any of the details of the description therein but includes all the embodiments which fall within the scope of the appended claims.

What is claimed is:

1. An accompaniment control device comprising:

a control circuit which detects an input state of inputted melody sounds for each of a plurality of differently-pitched sound ranges, and controls a sound emission state of accompaniment sounds for each sound range in accordance with the detected input state of the melody sounds for each sound range such that the sound emission state of accompaniment sounds in a first sound range among the plurality of sound ranges is adjusted in accordance with the detected input state of the melody sounds only in the first sound range and not in accordance with the detected input state of the melody sounds in a second sound range among the plurality of sound ranges, wherein the second sound range is outside of the first sound range.

2. The accompaniment control device according to claim 1, wherein the control circuit controls the sound emission state of the accompaniment sounds for each sound range in accordance with the input state of the melody sounds for each sound range in a manner that the input state of the melody sounds for each sound range and the sound emission state of the accompaniment sounds for each sound range have a predetermined relation.

3. The accompaniment control device according to claim 1, wherein the control circuit controls the sound emission state of the accompaniment sounds such that the sound emission state of the accompaniment sounds is different for each sound range in accordance with input state differences of the melody sounds among the sound ranges.

4. The accompaniment control device according to claim 1, wherein the control circuit sets a sound volume of the accompaniment sounds such that the sound volume of the accompaniment sounds is low in a sound range where a sound volume of the melody sounds is high, and that the sound volume of the accompaniment sounds is decreased as the sound volume of the melody sounds is increased in each sound range.

5. The accompaniment control device according to claim 1, wherein the control circuit includes:

a sound range division section which divides the melody sounds into the plurality of sound ranges;

an accompaniment sound source circuit which generates the accompaniment sounds for each sound range; and a volume control circuit which controls a sound volume of the generated accompaniment sounds for each sound range on a basis of a sound volume of the melody sounds for each sound range acquired by the division.

6. The accompaniment control device according to claim 1, wherein the control circuit divides the accompaniment sounds into a plurality of parts in different sound ranges from among the plurality of sound ranges, and controls sound volumes of the respective parts in parallel in accordance with a sound volume of the melody sounds for each sound range.

7. The accompaniment control device according to claim 1, wherein the control circuit is actualized by a hardware processor that is configured, under control of a program, to perform a function of detecting the input state of the inputted melody sounds for each sound range and controlling the sound emission state of the accompaniment sounds for each sound range in accordance with the detected input state of the melody sounds for each sound range.

8. The accompaniment control device according to claim 1, wherein the control circuit includes a filter circuit that divides the inputted melody sounds into the plurality of sound ranges, and wherein the control circuit detects the input state of the inputted melody sounds in each of the plurality sound ranges into which the inputted melody sounds are divided by the filter circuit.

9. A control method for controlling accompaniment sounds by a device including a control circuit, the control method comprising:

detecting, by the control circuit, an input state of inputted melody sounds for each of a plurality of differently-pitched sound ranges, and controlling, by the control circuitry, a sound emission state of the accompaniment sounds for each sound range in accordance with the detected input state of the melody sounds for each sound range such that the sound emission state of accompaniment sounds in a first sound range among the plurality of sound ranges is adjusted in accordance with the detected input state of the melody sounds only in the first sound range and not in accordance with the detected input state of the melody sounds in a second sound range among the plurality of sound ranges, wherein the second sound range is outside of the first sound range.

10. The control method according to claim 9, wherein the sound emission state of the accompaniment sounds for each sound range is controlled in accordance with the input state of the melody sounds for each sound range in a manner that the input state of the melody sounds for each sound range and the sound emission state of the accompaniment sounds for each sound range have a predetermined relation.

11. The control method according to claim 9, wherein the sound emission state of the accompaniment sounds is controlled such that the sound emission state of the accompaniment sounds is different for each sound range in accordance with input state differences of the melody sounds among the sound ranges.

12. The control method according to claim 9, wherein the controlling the sound emission state of the accompaniment sounds comprises setting, by the control circuit, a sound volume of the accompaniment sounds such that the sound volume of the accompaniment sounds is low in a sound range among the plurality of sound ranges where a sound volume of the melody sounds is high, and such that the sound volume of the accompaniment sounds is decreased as the sound volume of the melody sounds is increased in each sound range.

13. The control method according to claim 9, wherein:

the control circuit includes a filter circuit, and the method further comprises dividing, by the filter circuit, the inputted melody sounds into the plurality of sound ranges, and wherein the detecting the input state of the inputted melody sound comprises detecting the input state of the inputted melody sounds in each of the plurality sound ranges into which the inputted melody sounds are divided by the filter circuit.

14. A non-transitory computer-readable storage medium having stored thereon a program that is executable by a computer to actualize functions comprising:

detecting an input state of inputted melody sounds for each of a plurality of differently-pitched sound ranges; and controlling a sound emission state of accompaniment sounds for each sound range in accordance with the detected input state of the melody sounds for each sound range such that, the sound emission state of accompaniment sounds in a first sound range among the plurality of sound ranges is adjusted in accordance with the detected input state of the melody sounds only in the first sound range and not in accordance with the detected input state of the melody sounds in a second sound range among the plurality of sound ranges, wherein the second sound range is outside of the first sound range.

15. The non-transitory computer-readable storage medium according to claim 14, wherein the program is executable by the computer to control the computer to control the sound emission state of the accompaniment sounds for each sound range in accordance with the input state of the melody sounds for each sound range in a manner that the input state of the melody sounds for each sound range and the sound emission state of the accompaniment sounds for each sound range have a predetermined relation.

16. The non-transitory computer-readable storage medium according to claim 14, wherein the program is executable by the computer to control the computer to control the sound emission state of the accompaniment sounds such that the sound emission state of the accompaniment sounds is different for each sound range in accordance with input state differences of the melody sounds among the sound ranges.

17. The non-transitory computer-readable storage medium according to claim 14, wherein the program is executable by the computer to control the computer to set a sound volume of the accompaniment sounds such that the sound volume of the accompaniment sounds is low in a sound range where the sound volume of the melody sounds is high, and that the sound volume of the accompaniment sounds is decreased as the sound volume of the melody sounds is increased in each sound range.

18. The non-transitory computer-readable storage medium according to claim 14, wherein the program is executable by the computer to control the computer to actualize functions comprising:

dividing the inputted melody sounds into the plurality of sound ranges, wherein the detecting the input state of the inputted melody sound comprises detecting the input state of the inputted melody sounds in each of the plurality sound ranges into which the inputted melody sounds are divided.

* * * * *